US011624167B2

(12) United States Patent
Strom et al.

(10) Patent No.: US 11,624,167 B2
(45) **Date of Patent: *Apr. 11, 2023**

(54) PORTABLE COFFERDAM SYSTEM

(71) Applicant: Subsurface, Inc., Fargo, ND (US)

(72) Inventors: Gary H. Strom, Moorhead, MN (US); Brandon G. Strom, Vergas, MN (US)

(73) Assignee: Subsurface, Inc., Fargo, ND (US)

( * ) Notice: Subject to any disclaimer, the term of this patent is extended or adjusted under 35 U.S.C. 154(b) by 7 days.

This patent is subject to a terminal disclaimer.

(21) Appl. No.: 17/502,740

(22) Filed: Oct. 15, 2021

(65) Prior Publication Data

US 2022/0034059 A1 Feb. 3, 2022

Related U.S. Application Data

(63) Continuation of application No. 17/062,854, filed on Oct. 5, 2020, now Pat. No. 11,149,401, which is a continuation of application No. 16/594,158, filed on Oct. 7, 2019, now Pat. No. 10,794,033, which is a continuation of application No. 16/159,917, filed on Oct. 15, 2018, now Pat. No. 10,435,860, which is a continuation of application No. 15/953,629, filed on Apr. 16, 2018, now Pat. No. 10,100,483, which is a continuation of application No. 15/292,977, filed on Oct. 13, 2016, now Pat. No. 9,945,091.

(51) Int. Cl.

| | |
|---|---|
| ***E02D 19/04*** | (2006.01) |
| ***E02D 19/00*** | (2006.01) |
| ***E02D 17/04*** | (2006.01) |
| ***E02D 17/08*** | (2006.01) |

(52) U.S. Cl.
CPC ..... *E02D 19/04* (2013.01); *E02D 17/04* (2013.01); *E02D 17/08* (2013.01); *E02D 19/00* (2013.01)

(58) Field of Classification Search
CPC combination set(s) only.
See application file for complete search history.

(56) References Cited

U.S. PATENT DOCUMENTS

| | | | |
|---|---|---|---|
| 859,295 | A | 7/1907 | Hill |
| 1,176,294 | A | 3/1916 | Hill |
| 1,779,100 | A | 10/1930 | Mauterer |
| 1,806,967 | A | 5/1931 | Dougherty |
| 1,837,787 | A | 12/1931 | Meiser |
| 1,884,686 | A | 10/1932 | Hilpert |
| 2,050,934 | A | 8/1936 | Ditchburn |
| 3,688,508 | A | 9/1972 | Taylor |

(Continued)

OTHER PUBLICATIONS

Non-Final Office Action Document Received for U.S. Appl. No. 17/584,723; dated Sep. 21, 2022.

(Continued)

*Primary Examiner* — Kyle Armstrong
(74) *Attorney, Agent, or Firm* — Neustel Law Offices

(57) ABSTRACT

A portable cofferdam system for isolating a working area from water such as a culvert. The portable cofferdam system generally includes a first sidewall and a second sidewall each having an interior side, an exterior side, an upper edge, a lower edge and a rear edge. A middle wall is connected to the sidewalls opposite of the rear edges of the sidewalls forming a substantially U-shaped structure. An opening formed between the rear edges of the first sidewall and the second sidewall to allow for positioning about or near the inlet of an object or area to be kept dry such as the inlet of a culvert.

20 Claims, 14 Drawing Sheets

(56) References Cited

U.S. PATENT DOCUMENTS

| | | | |
|---|---|---|---|
| 3,822,557 | A | 7/1974 | Frederick |
| 4,028,901 | A | 6/1977 | Barber |
| 4,056,940 | A | 11/1977 | Fisher |
| 4,202,649 | A | 5/1980 | Cook |
| 5,304,015 | A | 4/1994 | Sonomura |
| 5,938,375 | A | 8/1999 | Wheeler, Jr. |
| 6,053,666 | A | 4/2000 | Irvine |
| 6,443,664 | B1 | 9/2002 | Horan |
| 6,474,911 | B1 | 11/2002 | Krings |
| 8,926,229 | B1 | 1/2015 | Clair |
| 2002/0054791 | A1 | 5/2002 | Nottingham |
| 2003/0053869 | A1 | 3/2003 | Moulin |
| 2004/0120775 | A1 | 6/2004 | Fomenkov |
| 2005/0226690 | A1 | 10/2005 | MacDonald |
| 2005/0238443 | A1 | 10/2005 | Heindl |
| 2006/0002768 | A1 | 1/2006 | Meyer |
| 2010/0104378 | A1 | 4/2010 | Moore |
| 2011/0064527 | A1 | 3/2011 | Nottingham |
| 2016/0108599 | A1 | 4/2016 | Spry |
| 2018/0106008 | A1 | 4/2018 | Strom |

OTHER PUBLICATIONS

U.S. Non-Final Rejection Issued from USPTO for U.S. Appl. No. 17/333,269; dated Sep. 29, 2021.

https://en.wikipedia.org/wiki/Cofferdam; Wikipedia Cofferdam Webpage Article; Printed & Received Sep. 28, 2016.

PORTABLE COFFERDAM SYSTEM

CROSS REFERENCE TO RELATED APPLICATIONS

The present application is a continuation of U.S. application Ser. No. 17/062,854 filed on Oct. 5, 2020 which issues as U.S. Pat. No. 11,149,401 on Oct. 19, 2021, which is a continuation of U.S. application Ser. No. 16/594,158 filed on Oct. 7, 2019 now issued as U.S. Pat. No. 10,794,033, which is a continuation of U.S. application Ser. No. 16/159,917 filed on Oct. 15, 2018 now issued as U.S. Pat. No. 10,435,860, which is a continuation of U.S. application Ser. No. 15/953,629 filed on Apr. 16, 2018 now issued as U.S. Pat. No. 10,100,483, which is a continuation of U.S. application Ser. No. 15/292,977 filed on Oct. 13, 2016 now issued as U.S. Pat. No. 9,945,091. Each of the aforementioned patent applications, and any applications related thereto, is herein incorporated by reference in their entirety.

STATEMENT REGARDING FEDERALLY SPONSORED RESEARCH OR DEVELOPMENT

Not applicable to this application.

BACKGROUND

Field

Example embodiments in general relate to a portable cofferdam system for isolating and dewatering a working area in a water environment such as a culvert.

Related Art

Any discussion of the related art throughout the specification should in no way be considered as an admission that such related art is widely known or forms part of common general knowledge in the field.

A cofferdam (also called a coffer) is a temporary enclosure built within a body of water and constructed to allow the enclosed area to be pumped out, creating a dry work environment for the major work to proceed. Enclosed coffers are commonly used for construction and repair of oil platforms, bridge piers and other support structures built within or over water. These cofferdams are usually welded steel structures, with components consisting of sheet piles, wales, and cross braces. Such structures are typically dismantled after the ultimate work is completed.

One of the problems with conventional cofferdams is they are labor intensive to install for small applications such as providing a dry working area surrounding a culvert. Another problem with conventional cofferdams is they require a significant amount of time to install. Another problem with conventional cofferdams are they are not designed for use in smaller work environments such as the area surrounding the inlet opening of a culvert.

SUMMARY

An example embodiment of the present invention is directed to a portable cofferdam system. The portable cofferdam system includes a first sidewall and a second sidewall each having an interior side, an exterior side, an upper edge, a lower edge and a rear edge. A middle wall is connected to the sidewalls opposite of the rear edges of the sidewalls forming a substantially U-shaped structure. An opening formed between the rear edges of the first sidewall and the second sidewall to allow for positioning about or near the inlet of an object or area to be kept dry such as the inlet of a culvert.

There has thus been outlined, rather broadly, some of the features of the portable cofferdam system in order that the detailed description thereof may be better understood, and in order that the present contribution to the art may be better appreciated. There are additional features of the portable cofferdam system that will be described hereinafter and that will form the subject matter of the claims appended hereto. In this respect, before explaining at least one embodiment of the portable cofferdam system in detail, it is to be understood that the portable cofferdam system is not limited in its application to the details of construction or to the arrangements of the components set forth in the following description or illustrated in the drawings. The portable cofferdam system is capable of other embodiments and of being practiced and carried out in various ways. Also, it is to be understood that the phraseology and terminology employed herein are for the purpose of the description and should not be regarded as limiting.

BRIEF DESCRIPTION OF THE DRAWINGS

Example embodiments will become more fully understood from the detailed description given herein below and the accompanying drawings, wherein like elements are represented by like reference characters, which are given by way of illustration only and thus are not limitative of the example embodiments herein.

DETAILED DESCRIPTION

Figure 1:
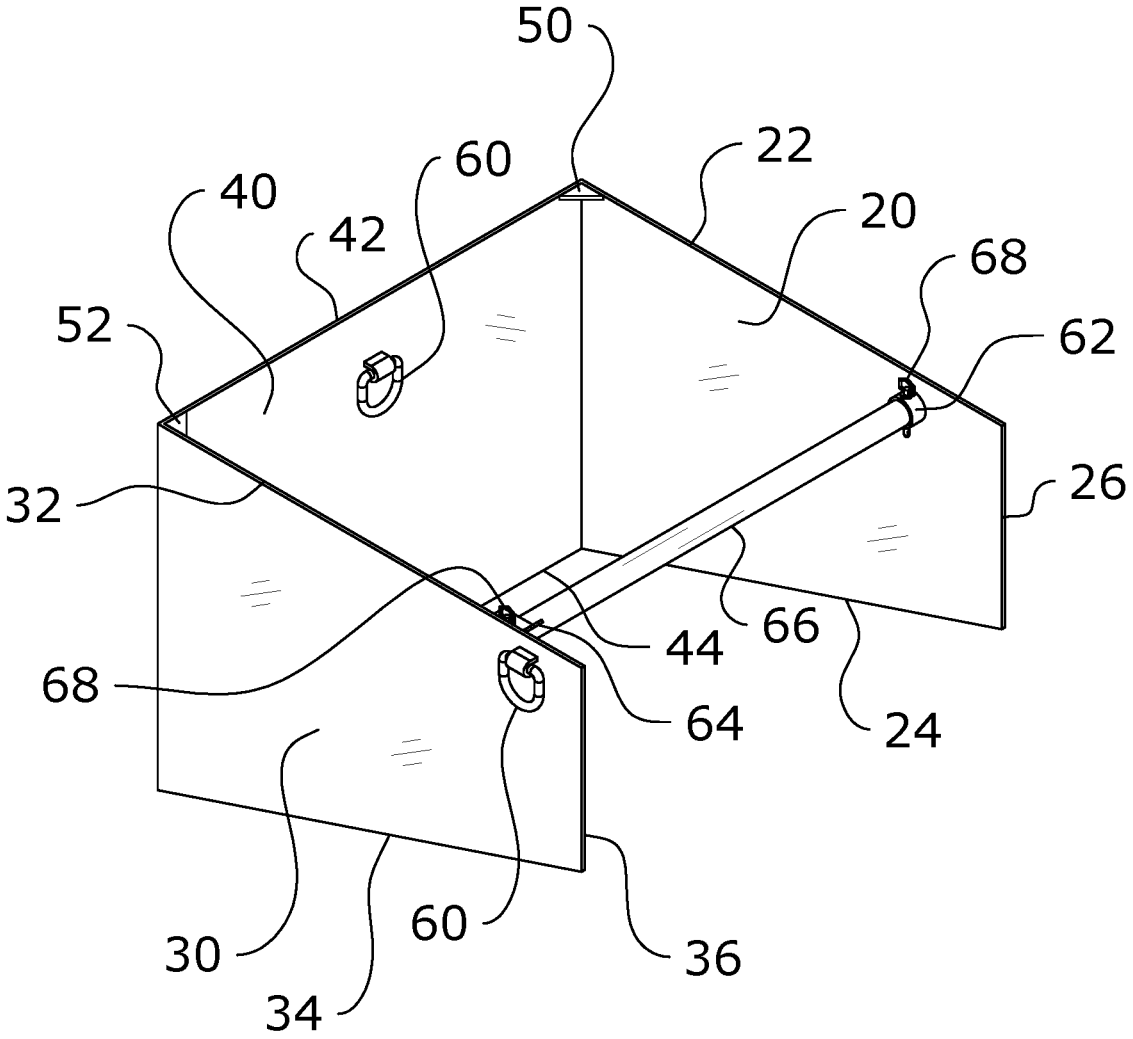
FIG. 1 is a left perspective view of a portable cofferdam system in accordance with an example embodiment.

A. Overview.

An example portable cofferdam system generally comprises a first sidewall 20 and a second sidewall 30 each having an interior side, an exterior side, an upper edge, a lower edge and a rear edge. A middle wall 40 is connected to the sidewalls opposite of the rear edges of the sidewalls forming a substantially U-shaped structure. An opening formed between the rear edges of the first sidewall 20 and the second sidewall 30 to allow for positioning about or near the inlet of an object or area to be kept dry such as the inlet of a culvert 10.

B. Portable Cofferdam.

The first sidewall 20 has an interior side, an exterior side, an upper edge 22, a lower edge 24 and a rear edge 26. The second sidewall 30 also preferably has an interior side, an exterior side, an upper edge 32, a lower edge 34 and a rear edge 36. The first sidewall 20 and the second sidewall 30 are vertically orientated so they may be inserted into the ground surface in a vertical manner. The second sidewall 30 is distally spaced from the first sidewall 20 a distance sufficient to provide a sufficient working area around the area or object to be kept dry (e.g. wider than the width of a culvert 10).

An opening is formed between the rear edges of the first sidewall 20 and the second sidewall 30 as illustrated in FIGS. 1 through 4 of the drawings. The opening preferably does not have a top or bottom with only the sidewalls 20, 30 defining the opening along with the surface of the ground the sidewalls 20, 30 are inserted into. The first sidewall 20 is preferably substantially parallel with respect to the second sidewall 30, but the first sidewall 20 may be positioned relative to the second sidewall 30 that is not substantially parallel.

The first sidewall 20 preferably has a shape and size substantially similar to the second sidewall 30 but different shapes and sizes may be used depending upon the application. Furthermore, the length from the rear edges 26, 36 to the middle wall 40 is preferably substantially the same for both sidewalls 20, 30 but the lengths may differ based on the desired application and area to be kept dry.

Figure 13:
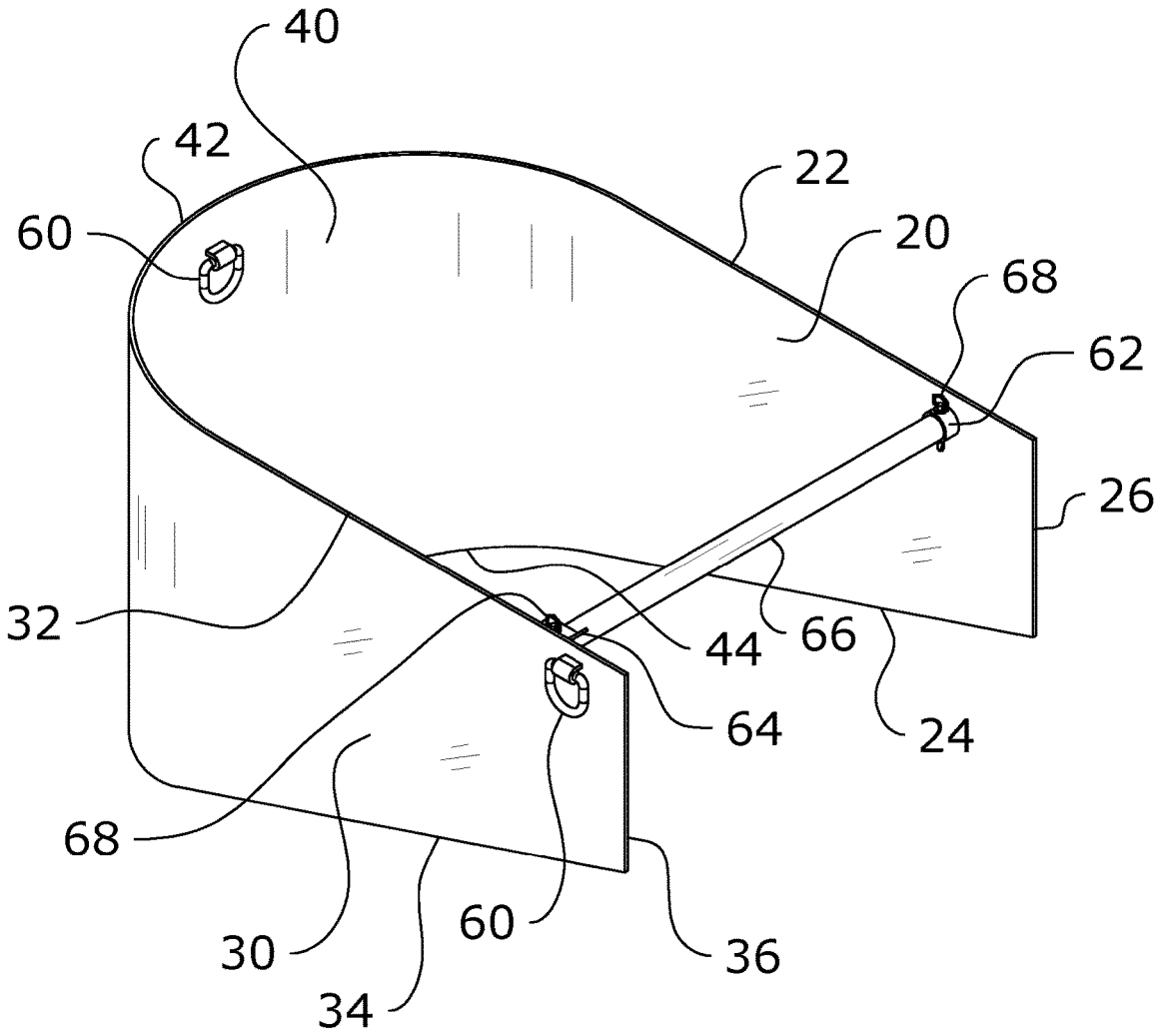
FIG. 13 is a left perspective view of a portable cofferdam system in accordance with an alternative embodiment.
Figure 14:
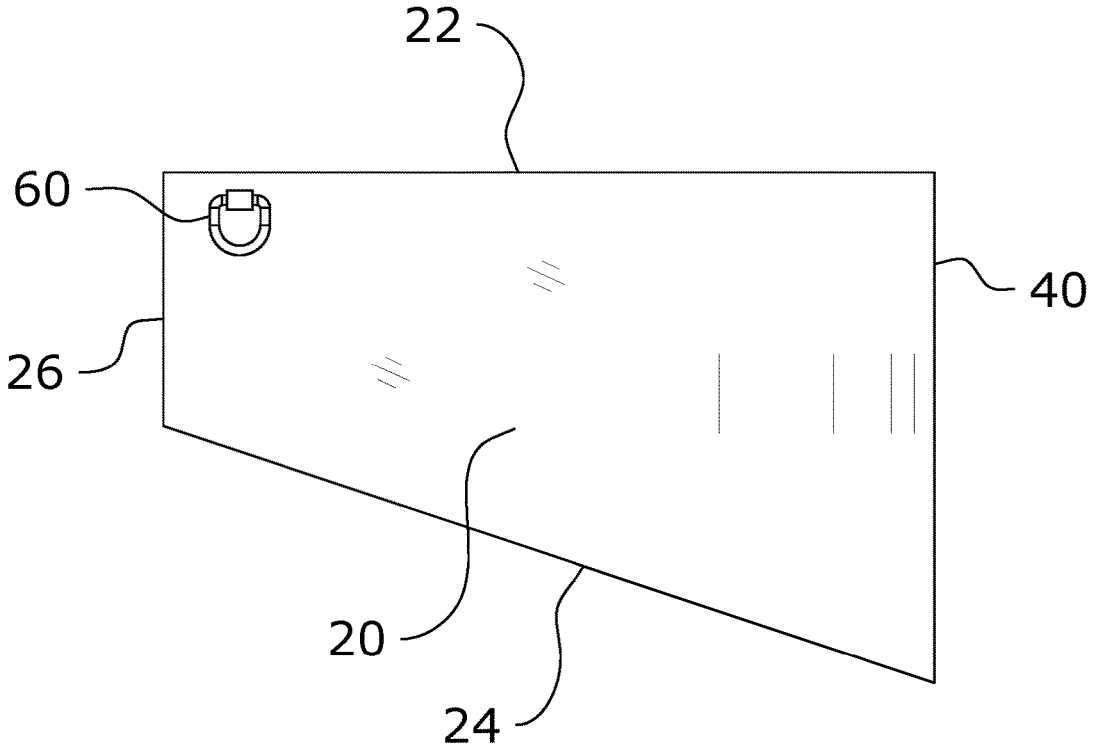
FIG. 14 is a right side view of the alternative embodiment shown in FIG. 13.
Figure 15:
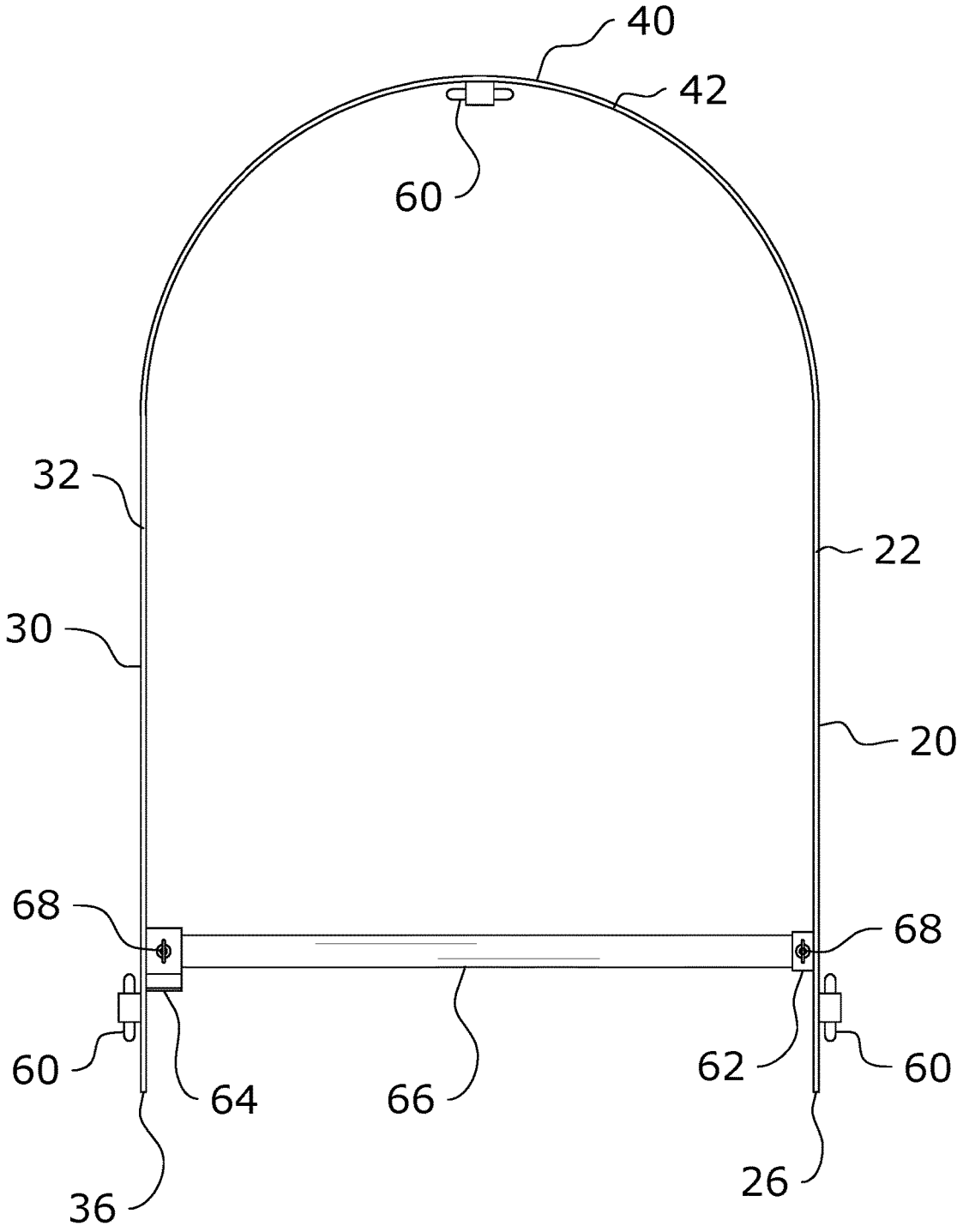
FIG. 15 is a top view of the alternative embodiment shown in FIG. 13.

The middle wall 40 has an interior side, an exterior side, an upper edge 42 and a lower edge 44. The middle wall 40 is also substantially vertically orientated. The first sidewall 20, the second sidewall 30 and the middle wall 40 are preferably all substantially vertically orientated at approximately the same angle to provide for easy insertion into the ground surface. As shown in FIGS. 1, 2, 8 and 9 of the drawings, the first side wall and the second sidewall 30 are preferably each substantially perpendicular with respect to the middle wall 40 in an example embodiment thereby forming a U-shaped structure as shown in FIGS. 1, 2, 8 and 9 of the drawings. In various other embodiments, the middle wall 40 may not be substantially perpendicular to the sidewalls 20, 30. For example, the middle wall 40 may be comprised of a curved structure thereby forming a U-shaped structure with the sidewalls 20, 30 as shown in FIGS. 13 through 15. The curved middle wall 40 allows for usage in larger applications without the need of additional bracing.

The walls 20, 30, 40 preferably are all constructed of metal plates having a relatively similar thickness (though the material types and thicknesses may vary). The lower edges 24, 34, 44 may be sharpened into a narrower state than the walls 20, 30, 40 to provide for easy penetration into the ground surface.

The first sidewall 20, the second sidewall 30 and the middle wall 40 are preferably comprised of a unitary structure (e.g. a single sheet of metal folded and/or formed to the desired shape). Alternatively, the walls 20, 30, 40 may be connected together via fasteners or welding. The walls 20, 30, 40 form a relatively water tight structure when inserted into the ground surface wherein a sloped ditch wall or other structure closes the interior of the structure around the area to be worked upon (e.g. an inlet of a culvert 10).

Though not required, the upper edges of the first sidewall 20, the second sidewall 30 and the middle wall 40 are preferably on or close to the same plane in one embodiment of the present invention. In alternative embodiments the upper edges of the walls 20, 30, 40 may be on different planes. The lower edges of the first sidewall 20, the second sidewall 30 and the middle wall 40 are preferably on or close to the same plane, but may have differing planes in some embodiments.

The first sidewall 20 and the second sidewall 30 both preferably taper outwardly from the rear edge to the middle wall 40 as shown in FIGS. 1, 2, 6 and 7. The first sidewall 20 and the second sidewall 30 both preferably taper outwardly from the rear edge to the middle wall 40 to allow for insertion of the middle wall 40 in deeper water 12 than the portion of the sidewalls 20, 30 near the rear edge thereby providing a relatively consistent height above the upper surface of the water 12. The middle wall 40 may taper upwardly towards the middle portion of the middle wall 40 to ensure that the middle wall 40 is above the level of water 12 approximately the same level as the sidewalls 20, 30.

C. Braces.

Figure 2:
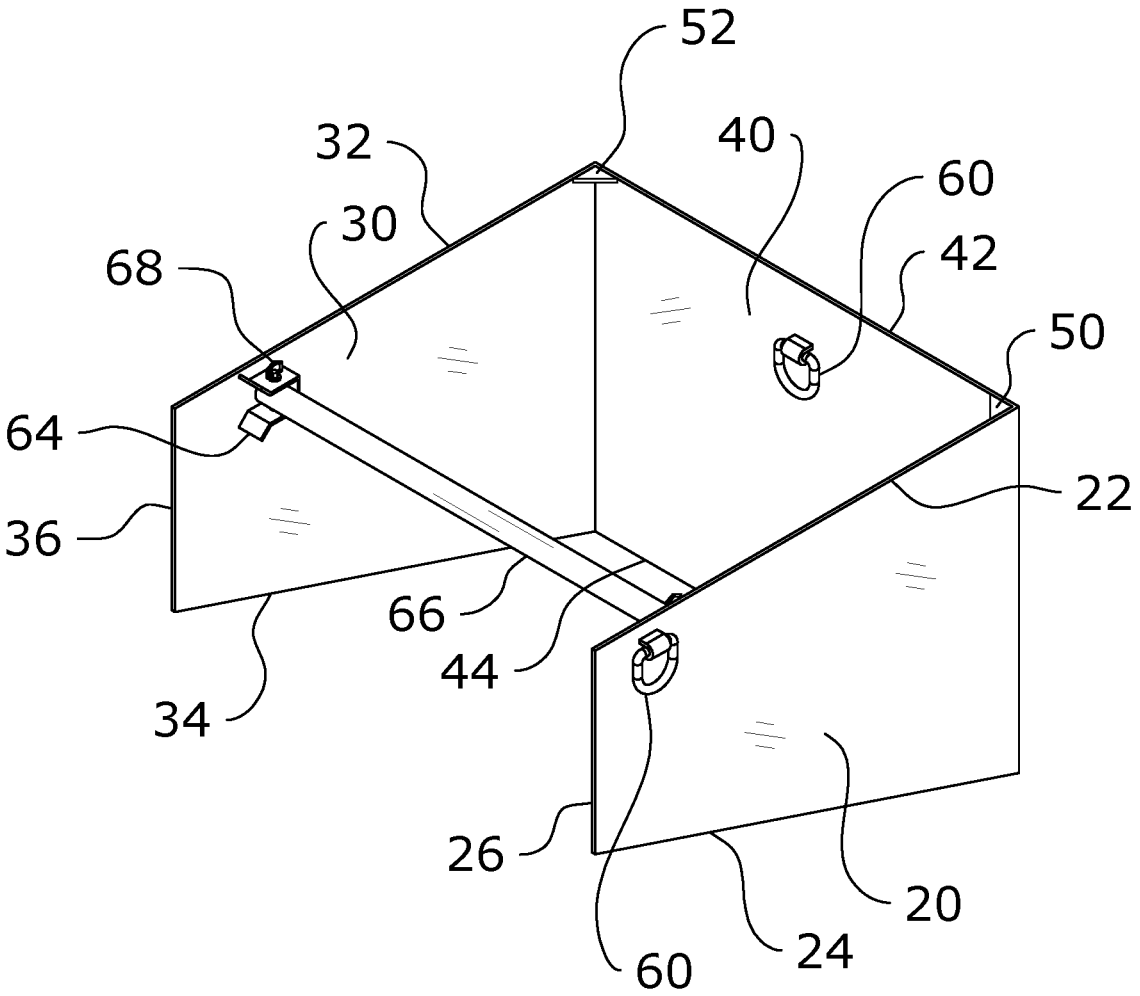
FIG. 2 is a right perspective view of a portable cofferdam system in accordance with the example embodiment.
Figure 3:
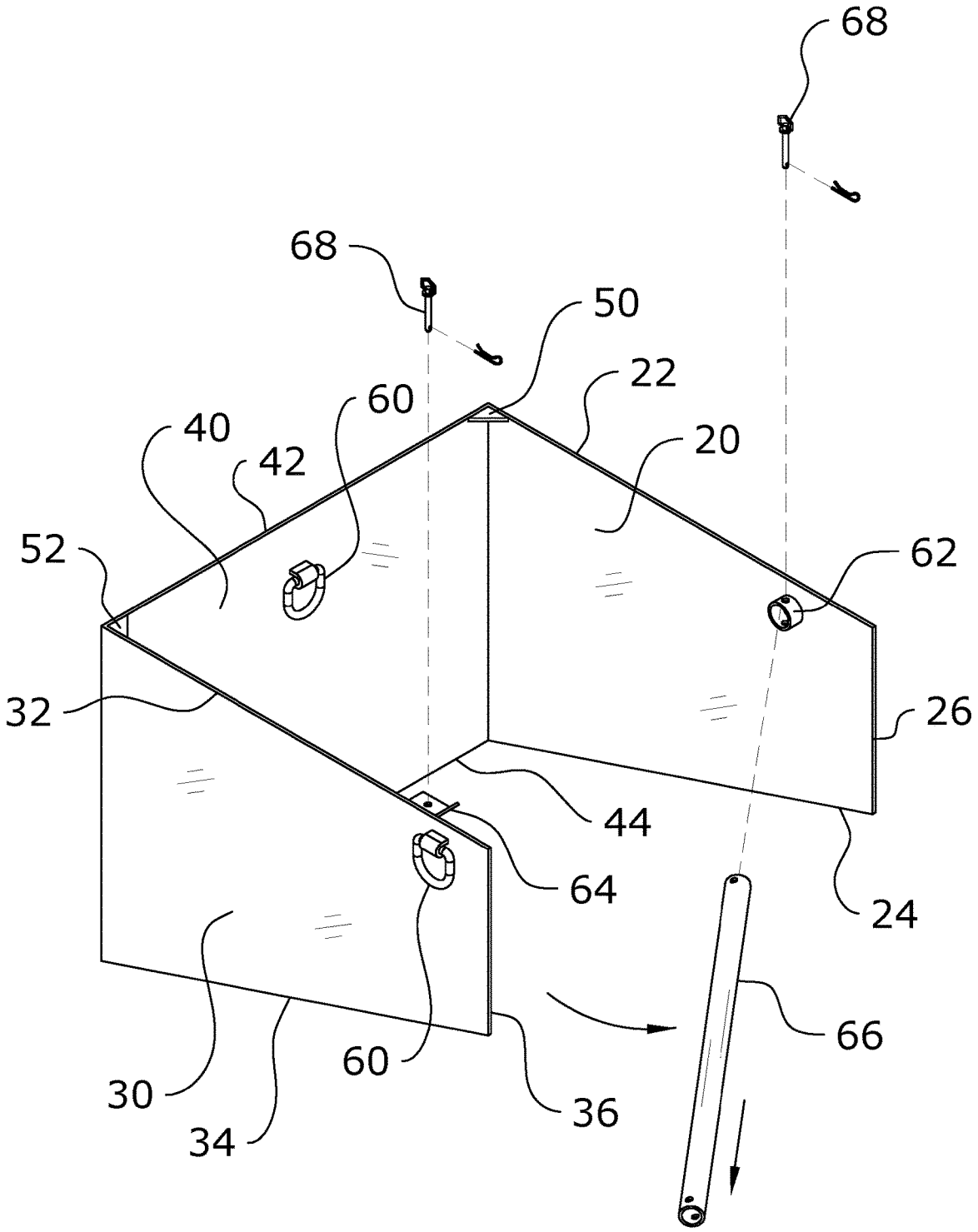
FIG. 3 is a left perspective view of the example embodiment with the support member removed.
Figure 4:
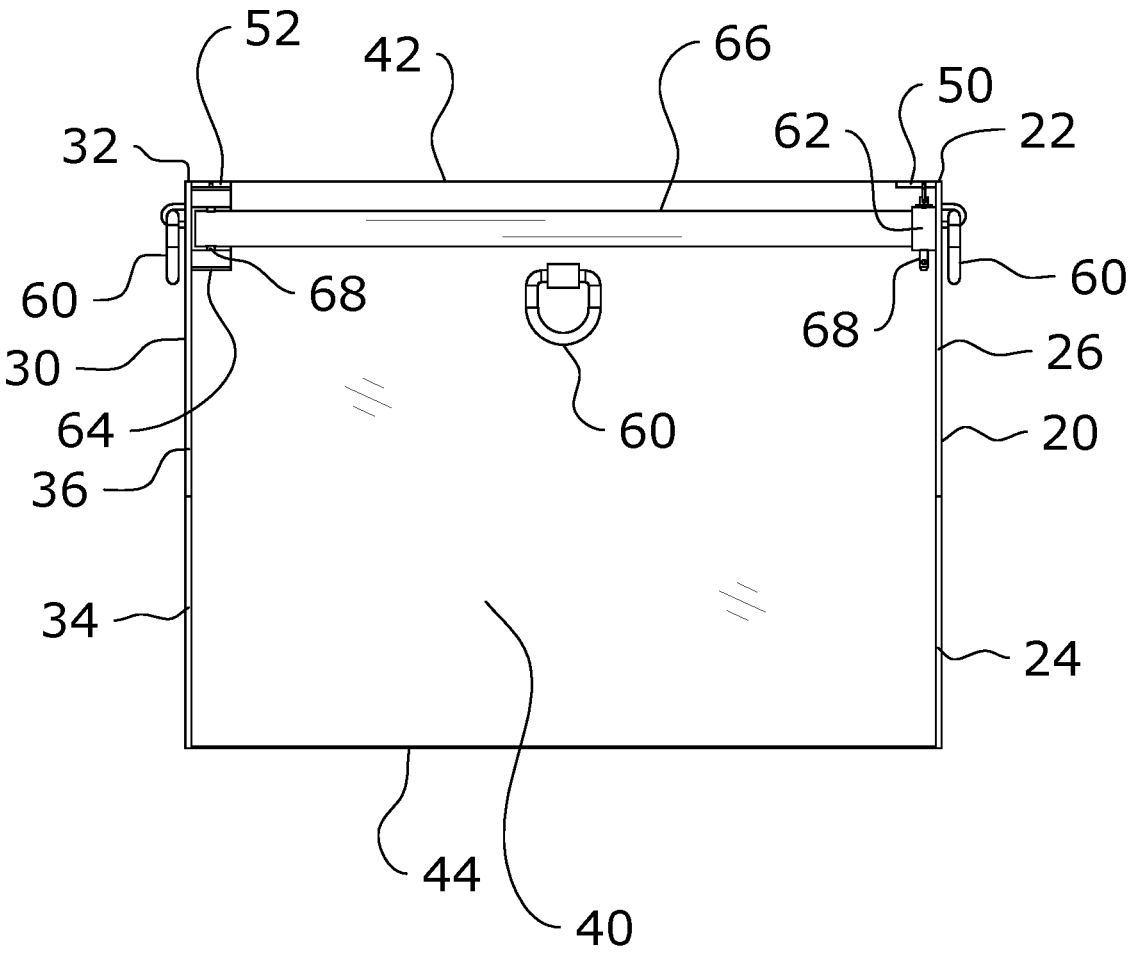
FIG. 4 is a rear view of the example embodiment.
Figure 5:
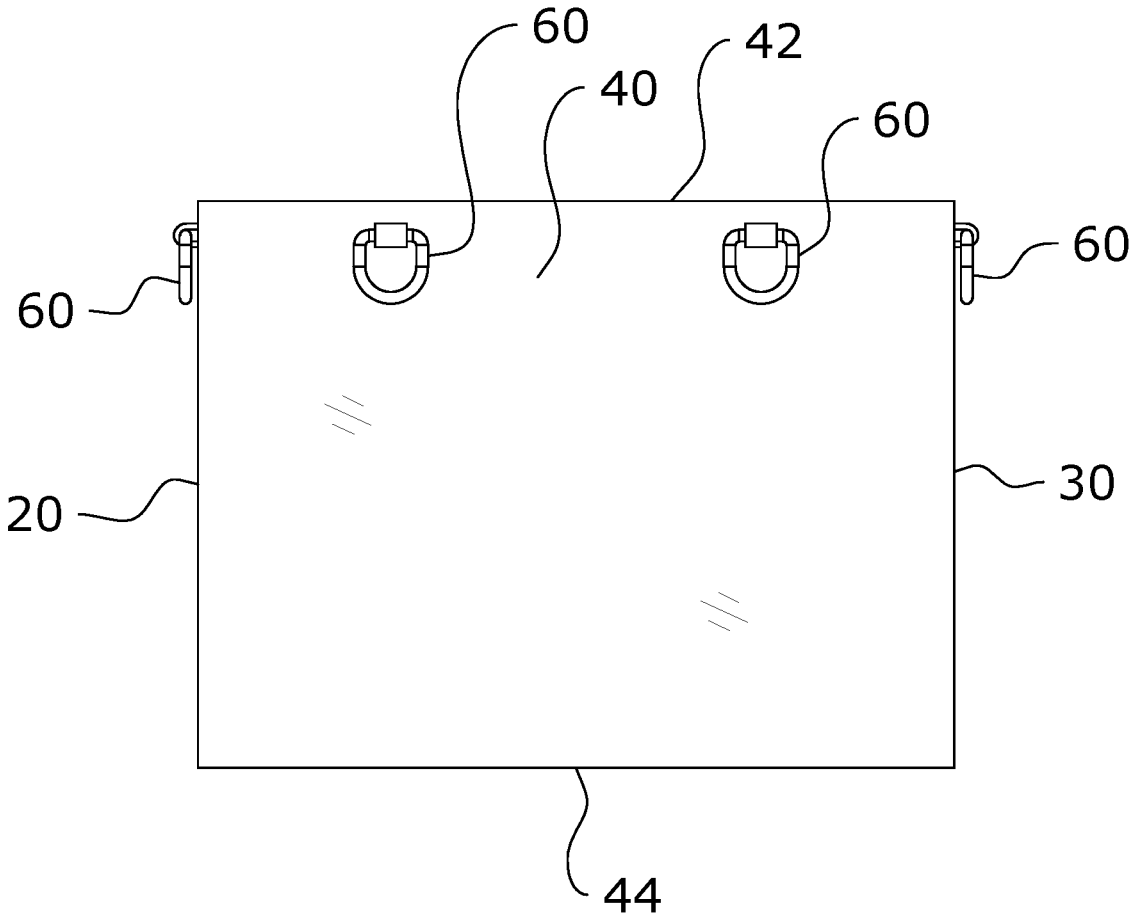
FIG. 5 is a front view of the example embodiment.
Figure 6:
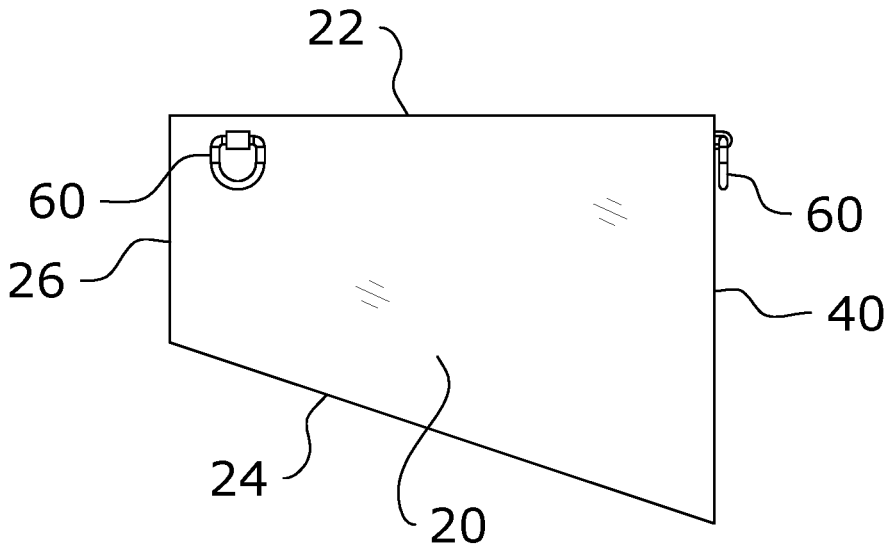
FIG. 6 is a right side view of the example embodiment.
Figure 7:
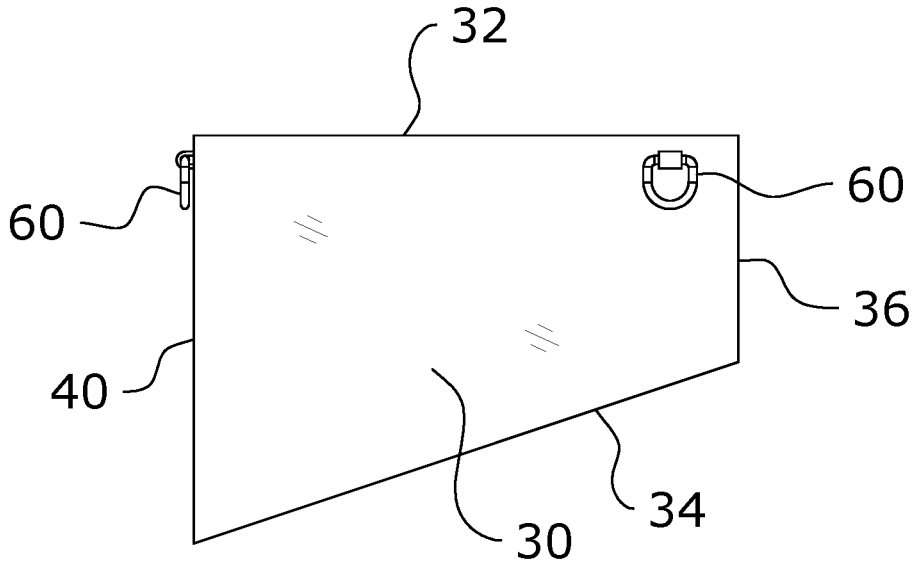
FIG. 7 is a left side view of the example embodiment.
Figure 8:
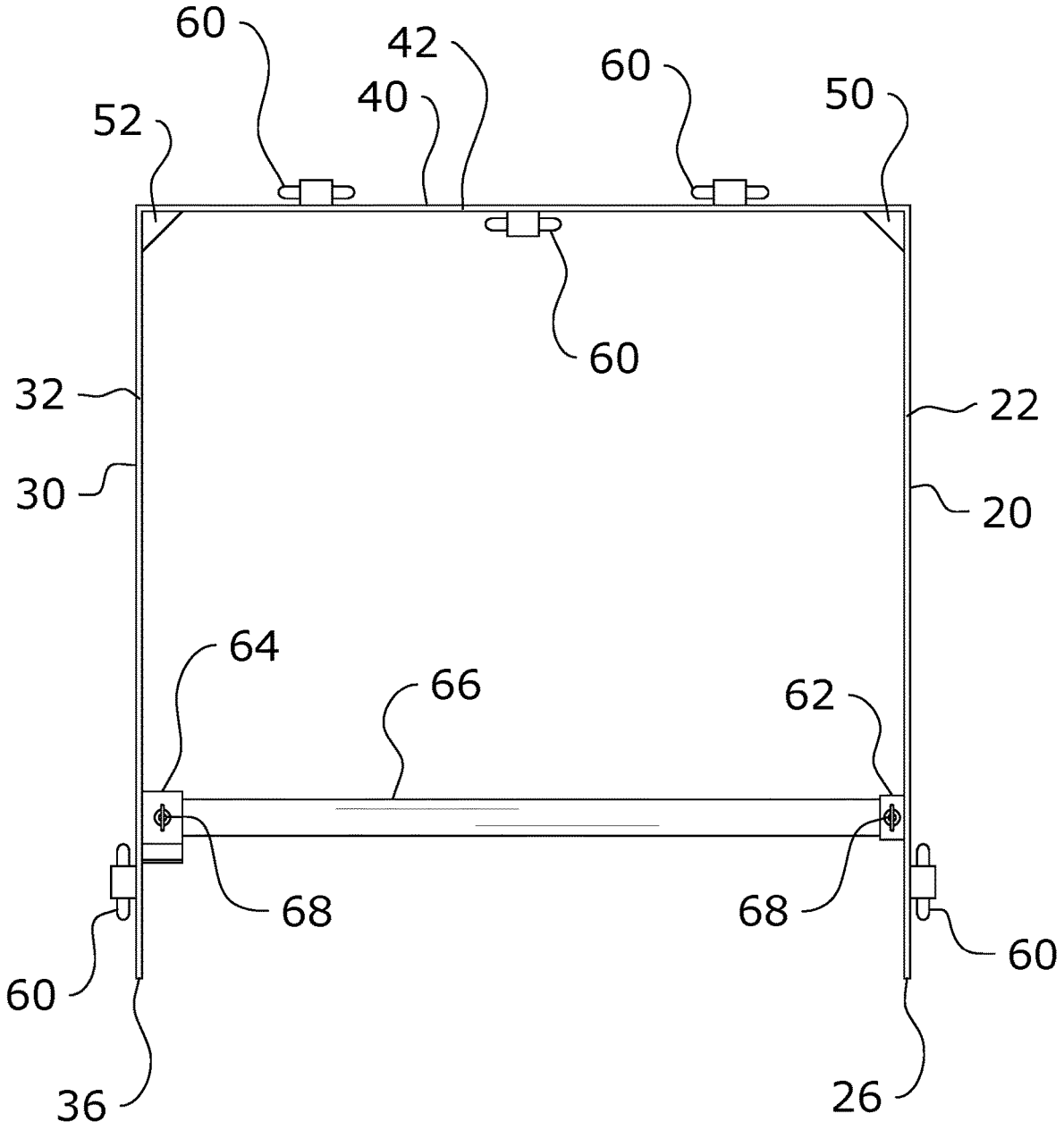
FIG. 8 is a top view of the example embodiment.
Figure 9:
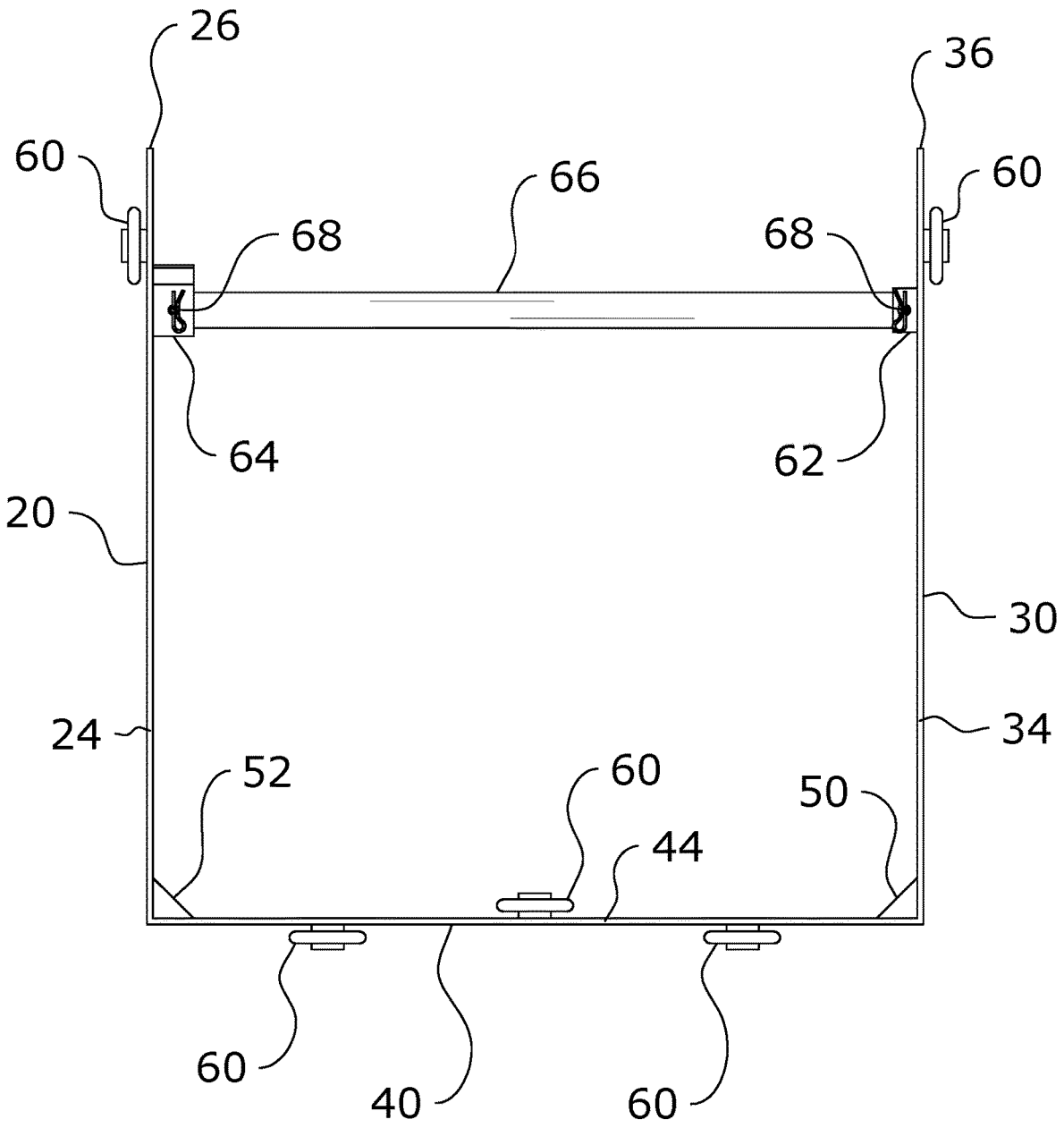
FIG. 9 is a bottom view of the example embodiment.

As shown in FIGS. 1 and 2, a first brace 50 is connected between the first sidewall 20 and the middle sidewall, and a second brace 52 is connected between the second sidewall 30 and the middle sidewall. The first brace 50 and the second brace 52 are preferably connected to the interior corners of the upper portion of the middle wall 40 and the sidewalls 20, 30. The braces 50, 52 are not required and are particularly not required for embodiments of the present invention that use a middle wall 40 that is outwardly curved as shown in FIGS. 13 through 15 of the drawings.

D. Connectors.

At least one connector 60 is preferably attached to the interior side and/or the exterior side of the middle wall 40. At least one connector 60 is preferably attached to the interior side and/or the exterior side of the first sidewall 20. At least one connector 60 is preferably attached to the interior side and/or the exterior side of the second sidewall 30. The connectors 60 may be comprised of any connector 60 that may be attached to devices such as, but not limited to, cables 17, ropes hooks, clamps, fasteners and the like. The connectors 60 are preferably comprised of a D-ring and in particular a D-ring that is pivotally attached to the walls 20, 30, 40. The connectors 60 may be comprised of other types of connectors 60 (e.g. hooks) and various combinations of connectors 60. The connectors 60 are used for various purposes such as, but not limited to, lifting and moving the walls 20, 30, 40 and/or attaching devices such as pulleys 16 or winches for performing various types of operations.

It can be appreciated that no connectors 60 may be attached to one or more of the sides of the walls 20, 30, 40. Furthermore, various numbers of connectors 60 may be used on any of the walls. In one preferred embodiment illustrated in FIGS. 1 through 5 of the drawings, one connector 60 is attached to an upper central portion of the interior side of the middle wall 40, two connectors 60 are attached to the upper central portion of the exterior side of the middle wall 40, one connector 60 is attached to the upper rear portion of the exterior side of the first sidewall 20 and one connector 60 is attached to the upper rear portion of the exterior side of the second sidewall 30. Various other combinations of connectors 60 may be used.

E. Support Member.

A support member 66 preferably extends between the interior sides of the first sidewall 20 and the second sidewall 30 near the rear edges of the sidewalls to provide additional support to the sidewalls 20, 30 during usage. The various embodiments of the present invention may be constructed with or without the support member 66. The support member 66 may be permanently attached or may be removably attached to the sidewalls 20, 30.

In one example embodiment, a first bracket 62 is attached to the interior side of the first sidewall 20, a second bracket 64 attached to the interior side of the second sidewall 30, and the first and second ends of the support member 66 are removably connected to the first bracket 62 and second bracket 64 respectively as shown in FIGS. 1 through 4 of the drawings. FIGS. 1 through 4 also show the first connector 60 having a ring structure with an aperture that receives a locking pin 68 that extends through the aperture in the first connector 60 and a corresponding aperture within the first end of the support member 66. FIGS. 1 through 4 also show the second connector 60 having a U-shaped structure with a tapered lower lip that allows the second end of the support member 66 to slide into the second bracket 64 wherein another locking pin 68 is inserted through corresponding apertures within the second bracket 64 and the support member 66. The user is able to easily remove the support member 66 to provide easy access to the dry work area 14 after the walls 20, 30, 40 have been inserted into the ground surface. The support member 66 may have a circular cross sectional shape or other cross sectional shape.

F. Operation of Preferred Embodiment.

Figure 10:
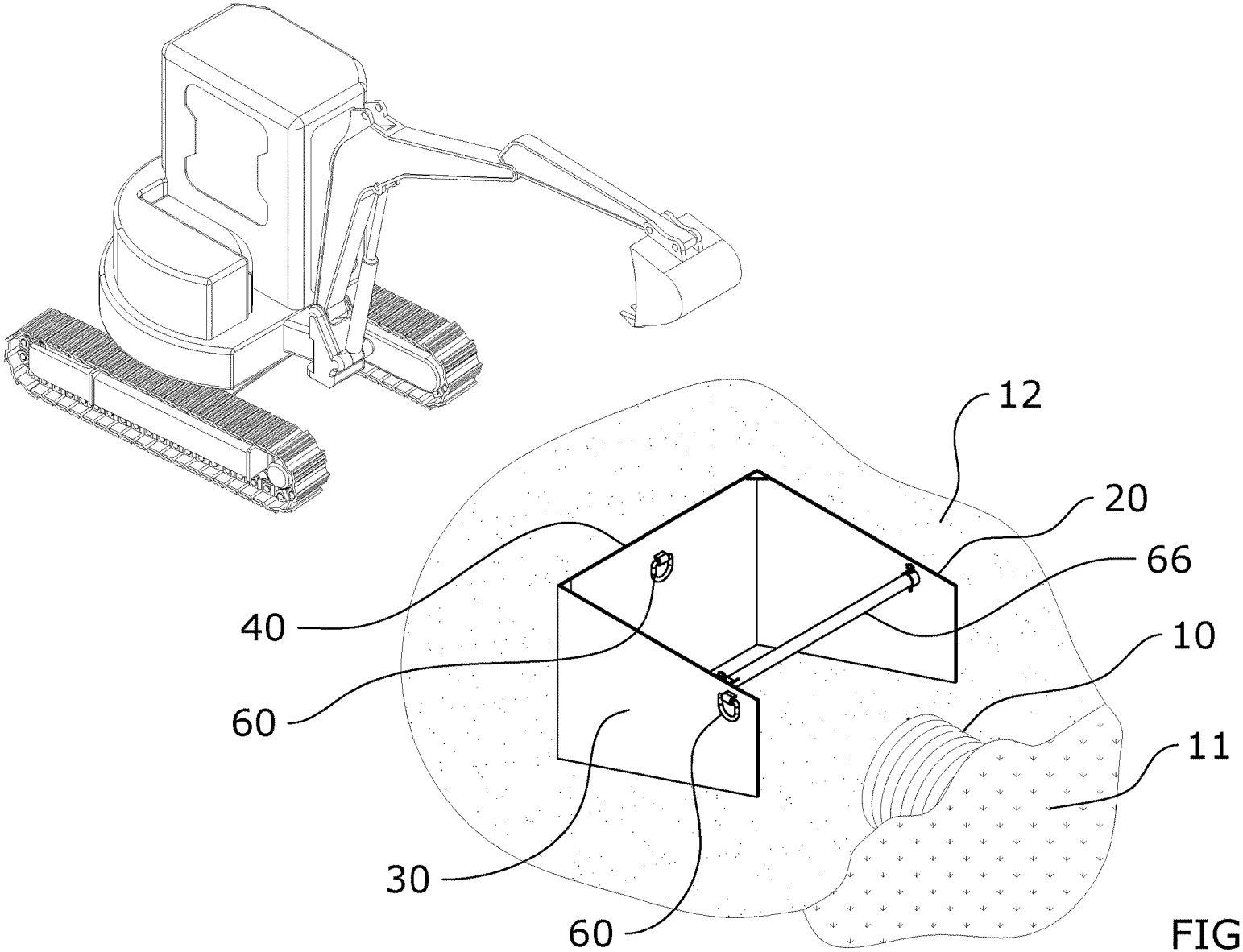
FIG. 10 is a left perspective view of the example embodiment transported to an example work area comprised of an inlet of a culvert.
Figure 11:
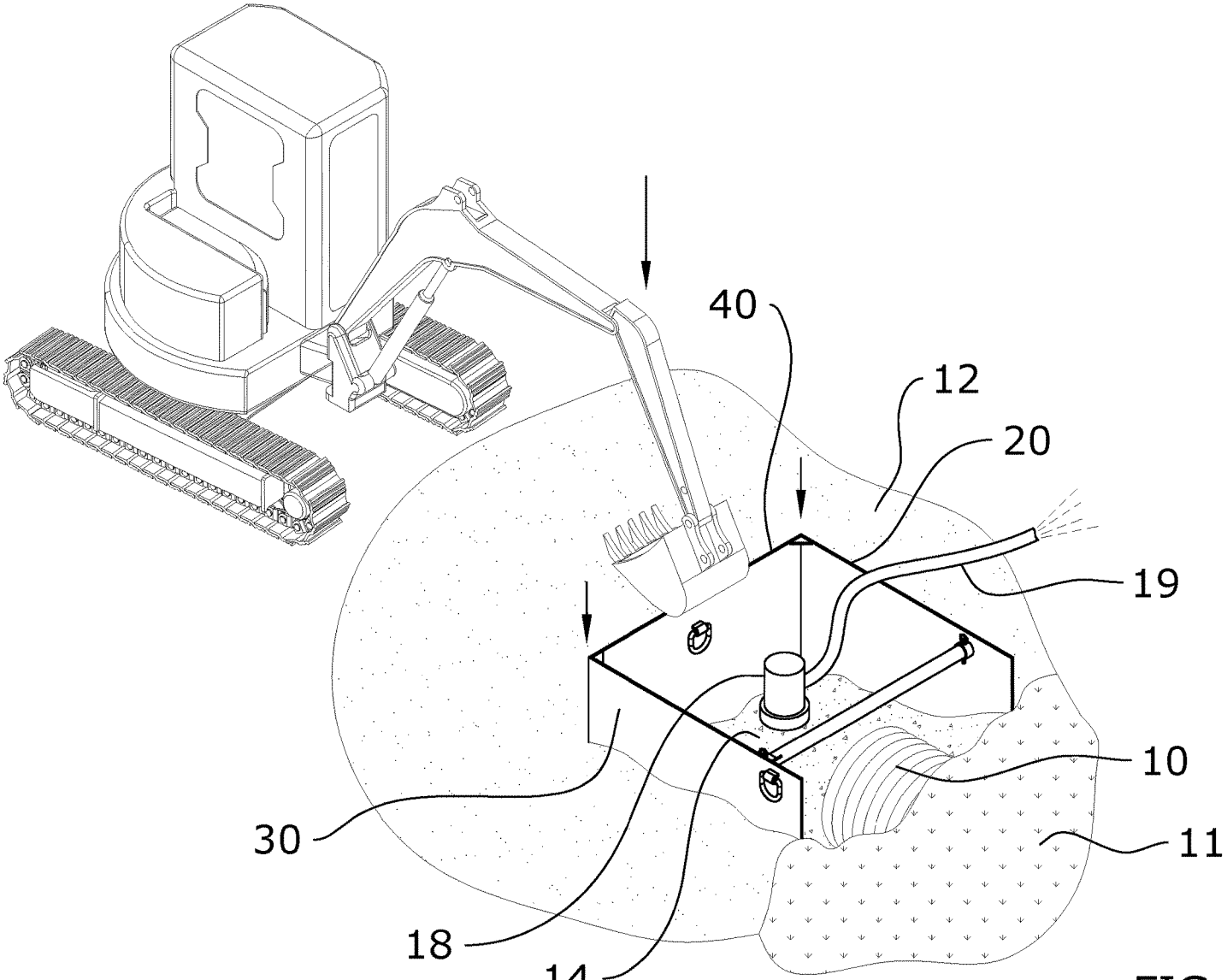
FIG. 11 is a left perspective view of the example embodiment being driven into the ground surrounding the inlet of the culvert with the bucket of a backhoe and a water pump inside the enclosed area removing water from the interior.
Figure 12:
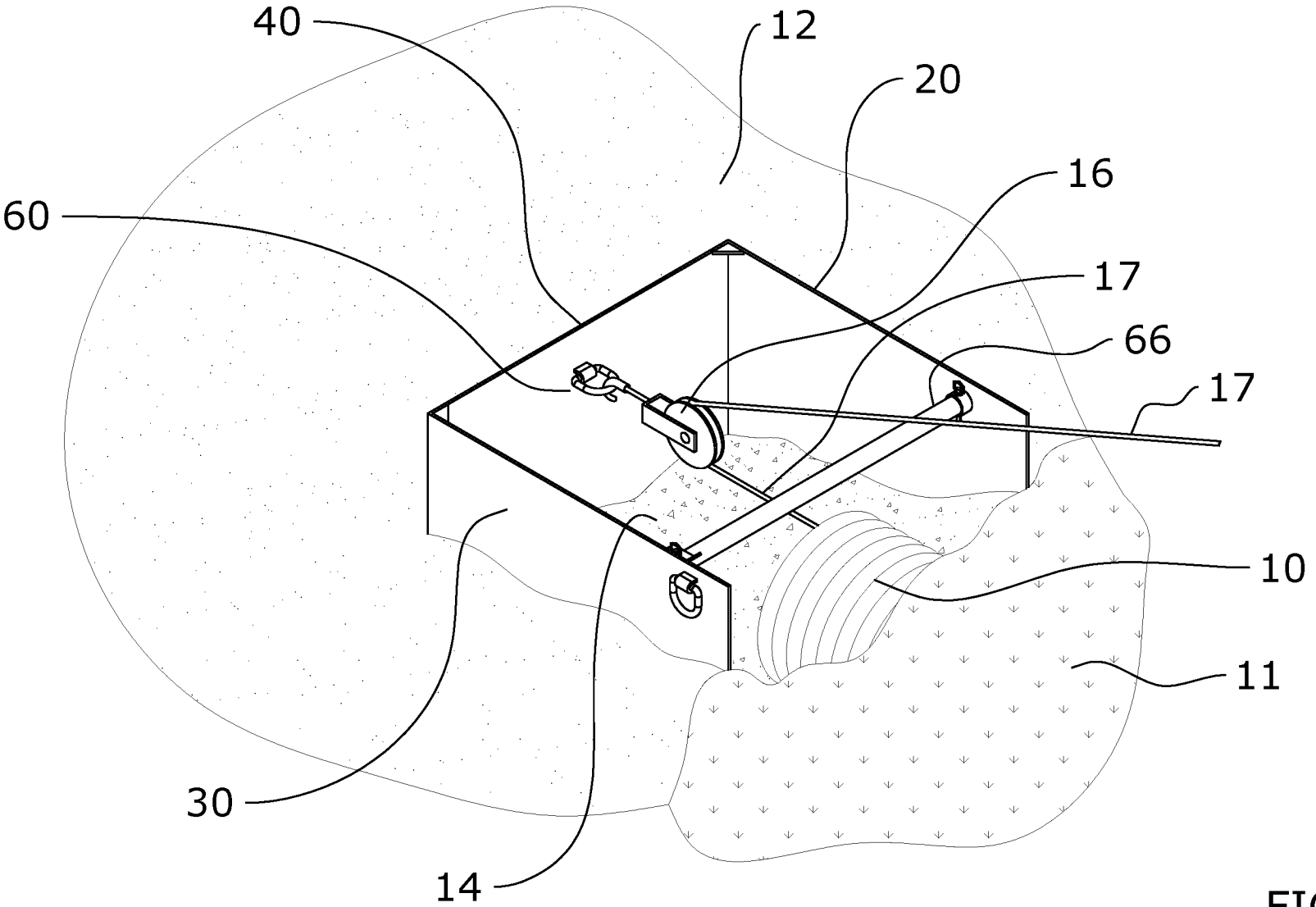
FIG. 12 is a left perspective view of the example embodiment with a pulley attached to a connector for a cable to movably extend about for manipulating an object within the culvert.

To use the various embodiments of the present invention, the user transports the portable cofferdam to a desired location that requires a dry work area 14 such as the intake of a culvert 10. The portable cofferdam is positioned in a manner that will result in the open end between the rear edges 26, 36 of the sidewalls closed off and water tight after the portable cofferdam is inserted into the ground surface to define the interior dry work area 14 to be pumped out of any liquids (e.g. water 12). To position the portable cofferdam, a cable 17 or other device is attached to one or more of the connectors 60 and to a backhoe (or similar machinery) to lift and move the portable cofferdam. For example, the user may position the rear portion of the portable cofferdam upon sloped ground 11 (e.g. the side of a ditch surrounding the culvert 10) with the opening between the rear edges 26, 36 facing towards the objection to be worked upon or with as shown in FIGS. 10 through 12 of the drawings.

After the portable coffer dam is properly positioned, the user then presses downwardly upon the portable cofferdam to drive the portable cofferdam into a ground surface that is below the water 12. The walls 20, 30, 40 of the portable cofferdam penetrate the ground surface a desired depth sufficient to ensure water 12 does not enter into the dry work area 14 (e.g. 6 inches depth or more). To force the portable cofferdam into the ground surface, the user may use the bucket of a backhoe or other type of vehicle (e.g. loader bucket on a tractor) to apply a downward force upon the walls 20, 30, 40 of the portable cofferdam. After the portable cofferdam is fully inserted, the user then pumps out the water 12 within the dry work area 14 with a water pump 18 that dispenses the water 12 outside of the dry work area 14 surrounded by the portable cofferdam using a hose 19 connected to the pump 18 and the sloped ground 11 thereby providing a dry work area 14 surrounding the inlet of the culvert 10 or other object/area to be worked upon in a dry environment. If work is being done on a culvert 10, it may be needed to use a second portable cofferdam on the opposite side of the culvert 10 using the above procedure.

After the dry work area 14 is free of water 12, various operations may be performed in the dry work area 14. For example, a pulley 16 may be attached to the connector 60 attached to the interior side of the middle wall 40 and a cable 17 from a winch is wrapped around the pulley 16 to enter the interior of the culvert 10 to be connected to an object such as a cured-in-place pipe (CIPP) liner to pull the CIPP liner from the opposite end of the culvert 10 through the interior of the culvert 10 to near the pulley 16. Conventional processes may be used to inflate the CIPP liner and cure the CIPP liner within the culvert 10 to repair and rehabilitate the culvert 10.

Once the user is finished using the portable cofferdam to maintain the dry work area 14, the user connects the backhoe (or other machinery) to one or more of the connectors 60 to lift the portable coffer dam from the ground surface. The user is then able to transport the portable coffer dam to a new work area using the same process indicated above.

Unless otherwise defined, all technical and scientific terms used herein have the same meaning as commonly understood by one of ordinary skill in the art to which this invention belongs. Although methods and materials similar to or equivalent to those described herein can be used in the practice or testing of the portable cofferdam system, suitable methods and materials are described above. All publications, patent applications, patents, and other references mentioned herein are incorporated by reference in their entirety to the extent allowed by applicable law and regulations. The portable cofferdam system may be embodied in other specific forms without departing from the spirit or essential attributes thereof, and it is therefore desired that the present embodiment be considered in all respects as illustrative and not restrictive. Any headings utilized within the description are for convenience only and have no legal or limiting effect.

What is claimed is:

1. A method of using a portable cofferdam, wherein the portable cofferdam is comprised of a first sidewall having an interior side, an exterior side, an upper edge, a lower edge and a rear edge, wherein the first sidewall is vertically orientated, a second sidewall having an interior side, an exterior side, an upper edge, a lower edge and a rear edge, wherein the second sidewall is vertically orientated and wherein the second sidewall is distally spaced from the first sidewall, a middle wall extending between the first sidewall and the second sidewall, the middle wall includes an interior side, an exterior side, an upper edge and a lower edge, wherein the middle wall is vertically orientated, and an opening formed between the rear edges of the first sidewall and the second sidewall, wherein the first sidewall, the second sidewall and the middle wall form a U-shaped structure, wherein the opening is adapted to be positioned about or near an inlet or an outlet of a culvert and wherein the rear edges of the first sidewall and the second sidewall are adapted to be positioned upon a sloped ground surrounding the inlet or the outlet of the culvert to close in a water tight manner an interior space formed between the first sidewall, the middle wall, the second sidewall and the sloped ground to prevent water from entering the inlet or the outlet of the culvert, said method comprising: positioning the portable cofferdam with the interior side of the middle wall facing the inlet of the culvert and the opening near the inlet of the culvert; and driving the portable cofferdam into a ground surface to a desired depth to prevent external water from entering the inlet of the culvert; and wherein the step of driving the portable cofferdam comprises a vehicle attachment pressing downwardly upon the portable cofferdam.

2. The method of claim 1, wherein the vehicle attachment comprises a bucket.

3. The method of claim 1, wherein the desired depth is 6 inches or more.

4. The method of claim 1, including removing water from the interior space of the portable cofferdam to provide a dry working area surrounding the inlet of the culvert.

5. The method of claim 4, wherein the step of removing water from the interior space of the portable cofferdam is comprised of pumping water from the interior space of the portable cofferdam with a water pump.

6. The method of claim 4, including pulling a cured-in-place pipe (CIPP) liner from the outlet of the culvert through the inlet of the culvert into the dry working area.

7. The method of claim 6, including curing the CIPP liner within the culvert.

8. The method of claim 1, including connecting a vehicle to the portable cofferdam and lifting the portable cofferdam from the ground surface.

9. The method of claim 8, including transporting the portable cofferdam to a new location.

10. A method of using a portable cofferdam, wherein the portable cofferdam is comprised of a first sidewall having an interior side, an exterior side, an upper edge, a lower edge and a rear edge, wherein the first sidewall is vertically orientated, a second sidewall having an interior side, an exterior side, an upper edge, a lower edge and a rear edge, wherein the second sidewall is vertically orientated and wherein the second sidewall is distally spaced from the first sidewall, a middle wall extending between the first sidewall and the second sidewall, the middle wall includes an interior side, an exterior side, an upper edge and a lower edge, wherein the middle wall is vertically orientated, and an opening formed between the rear edges of the first sidewall and the second sidewall, wherein the first sidewall, the second sidewall and the middle wall form a U-shaped structure, wherein the opening is adapted to be positioned about or near an inlet or an outlet of a culvert and wherein the rear edges of the first sidewall and the second sidewall are adapted to be positioned upon a sloped ground surrounding the inlet or the outlet of the culvert to close in a water tight manner an interior space formed between the first sidewall, the middle wall, the second sidewall and the sloped ground to prevent water from entering the inlet or the outlet of the culvert, said method comprising:

positioning the portable cofferdam with the interior side of the middle wall facing the outlet of the culvert and the opening near the outlet of the culvert; and driving the portable cofferdam into a ground surface to a desired depth to prevent external water from entering the outlet of the culvert.

11. The method of claim 10, wherein the step of driving the portable cofferdam is comprised of a bucket of a vehicle pressing downwardly upon the portable cofferdam.

12. The method of claim 10, wherein the desired depth is 6 inches or more.

13. The method of claim 10, including removing water from the interior space of the portable cofferdam to provide a dry working area surrounding the outlet of the culvert.

14. The method of claim 13, wherein the step of removing water from the interior space of the portable cofferdam is comprised of pumping water from the interior space of the portable cofferdam with a water pump.

15. The method of claim 13, including pulling a cured-in-place pipe (CIPP) liner from the outlet of the culvert through the outlet of the culvert into the dry working area.

16. The method of claim 15, including curing the cured-in-place pipe (CIPP) liner within the culvert.

17. The method of claim 10, including connecting a vehicle to the portable cofferdam and lifting the portable cofferdam from the ground surface.

18. The method of claim 17, including transporting the portable cofferdam to a new location.

19. A method of using a portable cofferdam, wherein the portable cofferdam is comprised of a first sidewall having an interior side, an exterior side, an upper edge, a lower edge and a rear edge, wherein the first sidewall is vertically orientated, a second sidewall having an interior side, an exterior side, an upper edge, a lower edge and a rear edge, wherein the second sidewall is vertically orientated and wherein the second sidewall is distally spaced from the first sidewall, a middle wall extending between the first sidewall and the second sidewall, the middle wall includes an interior side, an exterior side, an upper edge and a lower edge, wherein the middle wall is vertically orientated, and an opening formed between the rear edges of the first sidewall and the second sidewall, wherein the first sidewall, the second sidewall and the middle wall form a U-shaped structure, wherein the opening is adapted to be positioned about or near an inlet or an outlet of a culvert and wherein the rear edges of the first sidewall and the second sidewall are adapted to be positioned upon a sloped ground surrounding the inlet or the outlet of the culvert to close in a water tight manner an interior space formed between the first sidewall, the middle wall, the second sidewall and the sloped ground to prevent water from entering the inlet or the outlet of the culvert, said method comprising: connecting the portable cofferdam to a vehicle; lifting the portable cofferdam with the vehicle; positioning the portable cofferdam with the interior side of the middle wall facing the inlet or the outlet of the culvert; driving the portable cofferdam into a ground surface to a desired depth to prevent external water from entering the inlet or the outlet of the culvert; pumping water from the interior space of the portable cofferdam to provide a dry working area surrounding the inlet or the outlet of the culvert; and pulling a cured-in-place pipe (CIPP) liner from the outlet of the culvert through the inlet or the outlet of the culvert into the dry working area surrounding the inlet or the outlet of the culvert.

20. The method of claim 19, wherein the desired depth is 6 inches or more.

* * * * *